US012337374B2

(12) United States Patent
Haussler et al.

(10) Patent No.: US 12,337,374 B2
(45) Date of Patent: Jun. 24, 2025

(54) MACHINE AND METHOD FOR PRODUCING SIMPLY REINFORCED STEEL WIRE MESHES

(71) Applicants: BAM AG, St. Gallen (CH); PROGRESS MASCHINEN & AUTOMATION AG, Brixen (IT)

(72) Inventors: Franz Haussler, Passau (DE); Alexander Stuflesser, Lajen (IT)

(73) Assignees: BAM AG, St. Gallen (CH); PROGRESS MASCHINEN & AUTOMATION AG, Brixen (IT)

( * ) Notice: Subject to any disclaimer, the term of this patent is extended or adjusted under 35 U.S.C. 154(b) by 231 days.

(21) Appl. No.: 18/027,161

(22) PCT Filed: Aug. 30, 2021

(86) PCT No.: PCT/EP2021/073907

§ 371 (c)(1),
(2) Date: Mar. 20, 2023

(87) PCT Pub. No.: WO2022/073695

PCT Pub. Date: Apr. 14, 2022

(65) Prior Publication Data

US 2023/0330737 A1 Oct. 19, 2023

(30) Foreign Application Priority Data

Oct. 9, 2020 (DE) ..... 10 2020 126 584.0

(51) Int. Cl.

| | |
|---|---|
| ***B21F 27/02*** | (2006.01) |
| ***B21F 15/10*** | (2006.01) |
| ***B21F 27/08*** | (2006.01) |

(52) U.S. Cl.

CPC ..... *B21F 27/02* (2013.01)

(58) Field of Classification Search

CPC ..... B21F 27/02; B21F 27/08; B21F 27/005; B21F 27/10; B21F 15/10; B21F 33/002

See application file for complete search history.

(56) References Cited

U.S. PATENT DOCUMENTS 1,540,939 A * 6/1925 Hans ..... E04G 21/123 140/31
3,460,588 A * 8/1969 Hans ..... B21F 27/02 140/113

(Continued)

FOREIGN PATENT DOCUMENTS

DE 1966698 A1 11/1973
DE 9412405 U1 8/1995
DE 4436610 A1 10/1995

(Continued)

OTHER PUBLICATIONS

International Search Report with translation and Written Opinion for PCT application No. PCT/TR2021/050392, mailed Dec. 6, 2021.
International Application Status Report generated Jan. 31, 2023.

*Primary Examiner* — Mohammed S. Alawadi
(74) *Attorney, Agent, or Firm* — Notaro, Michalos & Zaccaria P.C.

(57) ABSTRACT

A machine and a method for producing uniaxial reinforcing steel bar meshes, in particular for uses with not predominantly static load, has reinforcing wires which are fastened to support strips by individual wire tying.

7 Claims, 2 Drawing Sheets

(56) References Cited

U.S. PATENT DOCUMENTS

Figure 1:
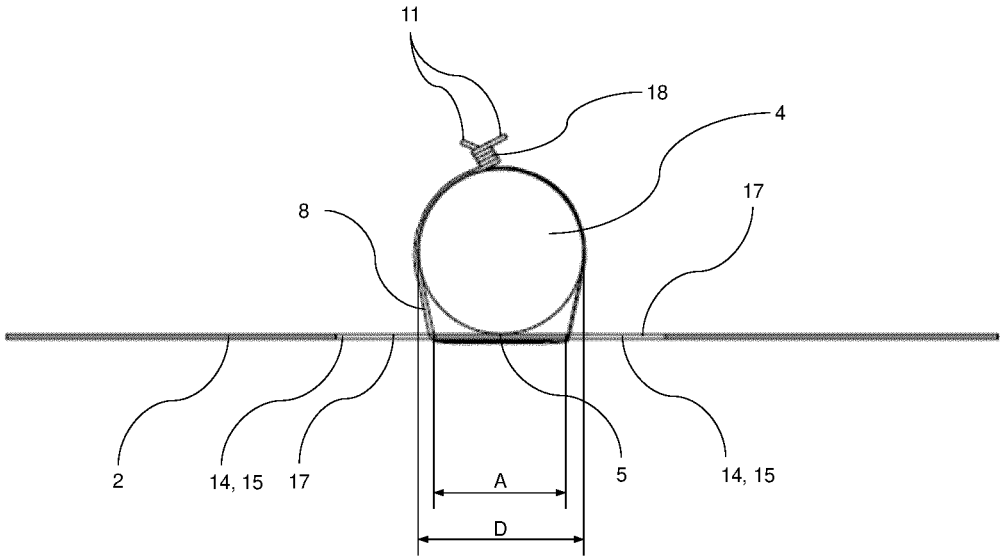

| | | | | | |
|---|---|---|---|---|---|
| 3,524,481 | A * | 8/1970 | Kirkwood | ..... | B21F 15/06<br>140/93 R |
| 7,909,067 | B2 * | 3/2011 | Offersen | ..... | B21F 27/12<br>140/45 |

FOREIGN PATENT DOCUMENTS

| | | | | | |
|---|---|---|---|---|---|
| EP | 0122883 | A2 | | 10/1984 | |
| EP | 0677343 | A1 | | 10/1995 | |
| EP | 0862958 | A2 | | 9/1998 | |
| EP | 1856346 | A1 | | 11/2007 | |
| GB | 2358154 | A | * | 7/2001 | ..... B21F 15/04 |
| JP | H06501529 | A | | 2/1994 | |
| WO | 2004009266 | A1 | | 1/2004 | |

* cited by examiner

MACHINE AND METHOD FOR PRODUCING SIMPLY REINFORCED STEEL WIRE MESHES

The present invention relates to a machine and a method for producing uniaxial reinforcing steel bar meshes, in particular those for uses with not predominantly static loads.

In reinforced concrete construction, steel bodies or bars are used to improve the static properties of concrete components, which absorb tensile forces and thus supplement the compressive strength of the concrete, so that the load-bearing capacity of the reinforced concrete components is improved. This is done in the form of steel bodies or bars made of reinforcing steel or round steel, delivered individually to the construction site and interwoven there by hand, by installing welded uniaxial or biaxial reinforcing meshes, or in segments in special shapes. Since uniaxial reinforcing steel meshes can absorb tensile forces in only one direction, their longitudinal direction, it follows that two uniaxial reinforcing steel meshes rotated 90° to each other are necessary per reinforced concrete component so that it can absorb tensile forces and bending moments in each direction. The cold- or hot-formed reinforcing steel bars are usually not twisted, have a nearly circular cross-section and an obliquely ribbed surface and, where necessary, have longitudinal ribs. Reinforcing steel bars are often up to 12 m long and usually have diameters of up to 40 mm, so they can reach weights of several hundred kilograms.

For predominantly static loads, welded connections have long been known and proven. Welded uniaxial reinforcing steel meshes have a particular advantage in that they can be laid on the construction site in a particularly time-saving manner. Corresponding machines have also been known for some time, for example from EP 0 862 958 or PCT/DE2009/000298. The machine described in EP 0 862 958 for the production of uniaxial reinforcing steel bar meshes has a lateral reinforcing steel bar supply to a mesh former, wherein the already fabricated reinforcing bars are either removed from a supply magazine or the reinforcing steel bars still to be fabricated are drawn off coils, straightened and cut to length by a bar former designed as an automatic straightening and cutting machine. The reinforcing steel bars fed into the mesh former are positioned transverse to the mesh by a transverse positioner and welded to flexible supporting strips by an automatic welding machine. The uniaxial reinforcing steel meshes have widths of up to 15 m and can contain reinforcing steel bars with different diameters and lengths. The thin steel strips having a certain width are used to roll out the reinforcing steel bars in a directionally stable manner. The width of the strip ensures good straight-line stability and the reinforcing steel bars lie exactly and stably in the previously calculated and planned position after rolling out.

However, welded reinforcing steel bar meshes are less suitable for reinforced concrete components and structures subject to loads that are not predominantly static, such as those occurring in civil or structural engineering and in building construction. Such reinforced concrete components include those used in road and railway bridges subjected to alternating loads from flowing traffic, those used in offshore wind turbines subjected to wave action, and those used in structures subject to dynamic excitation from gusty winds or vortex shedding, such as towers, masts, or high-rise buildings. Finally, structures that are not predominantly subjected to static loads include concrete components in industrial plants such as crane runways, forklift ceilings or machine foundations. In all these components, material fatigue can occur due to permanent, highly cyclic alternating stresses with a high number of load cycles. This type of stress is a major cause of damage in the aforementioned components and structures.

Since in welded joints the material fatigue behavior is locally concentrated mainly on the weld seam—due to microstructure change and strong notch effect, a significant reduction of the fatigue strength of the steel takes place—such a welded joint is known among experts to be problematic. For example, known welded reinforcing steel meshes or round bars do not achieve the fatigue strength specified by Eurocode 2 for use under loads that are not predominantly static due to the notch effect of the weld; they are well below the Wöhler line for bars. Therefore, for structural components with dynamic load, mainly single bars have been used so far, which had to be connected in laborious and time-consuming manner by hand on the construction site using thin wires, so that this production of a dynamically loadable surface is correspondingly expensive due to the cost-intensive manual connection. If welded reinforcing steel meshes were used instead, steel consumption increased significantly because a sufficiently large material allowance was required.

From EP 1 856 346 A1, a machine is known for the production of uniaxial reinforcing meshes, which feeds in the steel bars according to the same principle as described above but does not weld them onto a large number of flat, flexible steel strips arranged parallel to each other, but receives them at axially spaced points of the reinforcing bars in each case between two wires which are twisted together between the receiving points. In this machine, twisting bodies use two wires to produce a tightly twisted wire strand, the individual strands of which are guided around a fed-in reinforcing steel bar and receive the latter in an eye thus formed. In other words, for the permanent parallel arrangement of the reinforcing steel bars, instead of an endless steel strip as previously described, an in-situ generated endless wire strand is used. The disadvantage of this machine and this method is the insufficiently firm bond between the wire strand and the reinforcing steel bar and the associated risk of a change in position of the steel bar relative to the other steel bars of the uniaxial mesh, as well as the extremely low directional stability when rolling out the uniaxial mesh on the construction site.

DE 44 36 610 A1 discloses a machine in which reinforcing bars are fastened to strips by means of wire, one wire connector being arranged above the bar and one below the strip. One wire connector shoots a wire into an open deflection groove of the second wire connector which deflects it back onto the first wire connector where the wire enters a funnel-shaped hole. The first wire connector rotates a few revolutions until the end of the wire shears off.

It is therefore the object of the present invention to provide a machine for producing uniaxial reinforcing steel bar meshes for a predominantly non-static load, and a corresponding production method.

The device object is achieved by the machine described below, and the method object is solved by a method described further below.

The machine according to the invention has a steel strip conveyor for conveying a plurality of support strips parallel to one another and spaced apart from one another, and a reinforcing bar conveyor, the latter conveying individual reinforcing bars in a crossing manner onto the plurality of support strips, forming crossing points, and preferably also positioning them in a longitudinal-axial manner with respect thereto, and a plurality of connecting units operatively arranged at each crossing point, wherein a connecting unit has a binding wire conveyer feeding a binding wire through a rotating unit, wherein the rotating unit is movable relative to the support strip and the crossing reinforcing bar and is arranged on a side of the plane defined by both of them, and further having a binding wire guide unit which is arranged on the opposite side of the plane and which frictionally feeds out and holds a binding wire fed thereinto by the binding wire conveyer in a direction reverse to the infeed direction, wherein the rotating unit twists the two binding wire strands located on a side of the plane together and cuts them to length, wherein the rotating unit and the binding wire guide unit are moved towards each other in a closing manner to form a wire loop connecting the support strip and the reinforcing bar in such a manner that the support strip and the reinforcing bar are pressed against each other. As a result, this has the great advantage that an accurately located, precise, and durable connection between the support strip and the reinforcing bar is achieved, since the binding wire is neatly guided and does not have to be able to close a possible gap between the reinforcing bar and the support strip.

With great advantage, the reinforcing steel bars are fastened to wide, flat, flexible support strips, in particular steel strips, which can be rolled out in a directionally stable manner, but in a manner that does not require any material allowance or the use of highest-grade steels and is ideally suited for structural components that are not predominantly subjected to static loads. This is achieved by the wire loop according to the invention, which is looped around the support strip and the fed-in reinforcement steel bar at their crossing points and connects them in a force-fitting manner. In addition, the wire binding according to the invention allows the use of non-weldable material, such as epoxy coated steel, galvanized material or stainless steel for the reinforcing bars and thus for the uniaxial meshes. A uniaxial reinforcing steel bar mesh according to the invention therefore has a multiplicity of such wire loops. The number of wire loops per reinforcing bar corresponds to the number of support strips to which it is to be fastened in a crossing manner, thus, there are n-x wire loops per n support strips of the mesh, where x is a number between 0 and n−2.

In one configuration of the invention, it is provided that the machine has a cutoff device, in particular a knife, preferably a stationary knife in the region of the rotating unit. After the binding wire has been fed in at the required length, the rotating unit moves upwards away from the reinforcing bar, wherein the binding wire is cut off by the correspondingly shaped knife and at the same time, due to the further movement of the rotating unit and the resistance of the knife, is bent approximately against the direction of movement of the rotating unit, in particular even by up to 180°. The bent free end of the binding wire created in this manner advantageously effects pull-out resistance during rotation against pulling out from the binding wire guide in the rotating unit, as a result of which the binding between the support strip and the reinforcing bar is tight and firm.

Due to the fact that the machine bends a cut-to-length wire binding between the support strip and the crossing reinforcing bar, produced by the machine, from a predominantly orthogonal orientation to the plane to a predominantly parallel orientation to the plane, a risk of injury from otherwise protruding wire ends is advantageously avoided. With great advantage, the wire end of the wire loop after bending is in a plane with the reinforcing bars and the support strips in the rolling out direction and thus protected from contact with a user.

In one configuration of the invention, it is advantageously provided that the support strips have guides for the binding wires, in particular openings and/or recesses, wherein the machine preferably creates these guides in-situ. These guides advantageously create a guided, positionally invariable binding wire loop around the node, which cannot loosen even in the event of any bending or buckling of the support strip, for example when coiling or uncoiling the uniaxial reinforcing mesh. The guides can be holes in the support strip—in particular elongated holes—or notches in the edge regions of the support strip, or a combination of both.

Due to the fact that a distance A between two guides is selected depending on the diameter of the reinforcing bar to be connected in each case, and in particular that the distance A is smaller than the diameter of the reinforcing bar to be fastened, a firm binding is always achieved with great advantage for any different diameters of reinforcing bars. A web width adapted to the bar diameter prevents the bar from twisting. The web width can also be wider than the bar diameter. This results in a kind of clutching of the bar with positive effects on position stabilization and a tight binding.

In one refinement of the invention, it is provided that a length L of the binding wire 8 required for the connection is varied depending on the diameter of the respective reinforcing bar to be connected. On the one hand, this saves binding wire material and, on the other hand, the twisted binding wire sections or free ends of the wire loops created are always as short as possible and thus protrude as little as possible.

The method according to the invention for producing a uniaxial reinforcing mesh from a plurality of reinforcing bars which are parallel to each other and spaced apart from each other and which are oriented orthogonally to and fastened to a plurality of support strips which are parallel to each other and spaced apart from each other, comprises the following steps:

a) feeding a reinforcing bar orthogonally to the longitudinal axes of parallel support strips which are spaced apart from each other to create a plurality of crossing points between the respective steel strip and reinforcing bar,
b) pressing the reinforcing bar onto the support strip to hold them in close position,
c) feeding a binding wire in the region of a crossing point around the steel strip and the reinforcing bar to form a double binding wire strand on one side,
d) cutting the binding wire to length and twisting the two binding wire strands to form a twisting section.

In one configuration of the method, it is provided that after step d), a step e) of bending the twisting section in or toward the plane defined by support strips and reinforcing bars is carried out.

According to the invention, it is provided that a step of pressing the reinforcing bar onto the support strip takes place before, during, or after steps c) and/or d).

In one refinement of the method, step d) comprises bending the second free end of the binding wire created by cutting to length.

In one configuration of the method, a step f) of inserting guides into the support strip is provided.

The invention is explained in more detail below with reference to the figures of an exemplary embodiment, wherein the same components are designated by the same reference signs. In the figures FIG. 1: shows a schematic view of a wire loop, FIG. 2: shows a schematic sectional view of an embodiment of the machine in a first state, and FIG. 3: shows a schematic sectional view of an embodiment of the machine in a second state.

FIG. 1 shows a binding wire loop according to the invention around a crossing point 5 of a support strip 2—here a flat, flexible steel strip—and a reinforcing bar 4—here a bar made of a reinforcing steel. Elongated holes 17, the closest edge distance A between which is smaller than a diameter D of the reinforcing bar 4, can be seen in the support strip 2. Here, the two elongated holes 17 are an embodiment of the guide 14 according to the invention of the binding wire 8 in the form of openings 15. The binding wire 8 is guided through the two elongated holes 17 and the two binding wire strands 11 are twisted to form a twisting section 18 after the method according to the invention has been carried out, wherein, according to the invention, this twisting section 18 is also bent, in particular approximately parallel to the plane of the support strip 2 and reinforcing bar 4, in order to prevent it from protruding from the concrete at a later time and also to prevent injuries to a user. In this context, plane is not to be understood to mean a strictly mathematical two-dimensional plane, but rather the three-dimensional plane formed by support strip 2 and reinforcing bar 4. The width of the support strips 2 of a uniaxial reinforcing mesh is selected such that it can be rolled out with safe straight-line stability.

According to the invention, the reinforcing bars 4 are selected from those with diameters between 6 mm and 40 mm, wherein the distances between the parallel reinforcing bars 4 of a uniaxial reinforcing mesh can be freely selected in accordance with the requirements of the respective use of the uniaxial reinforcing mesh. This is done by computer-controlled optimized planning with regard to length, position, distance, diameter, material, etc. Preferably, a minimum distance is maintained between two adjacent reinforcing bars 4 in order to achieve a transfer safety.

The edge distance A of the web of the support strip 2 remaining between the elongated holes 17 is adapted to the bar diameter D to be bound. In particular, it is smaller or has the same width as the latter. This ensures that the binding does not become loose even if the support strip 2 is bent or kinked, especially during coiling in production. By adapting the size of the edge distance A, a tight binding is always achieved for any different diameters D of the reinforcing bars 4. It also prevents twisting of the reinforcing bar 4 about its longitudinal axis. According to the invention, this distance A is also selected to be wider than the bar diameter D. This results in a kind of clutching of the reinforcing bar 4 with positive effects on position stabilization while at the same time providing a firm binding.

Figure 2:
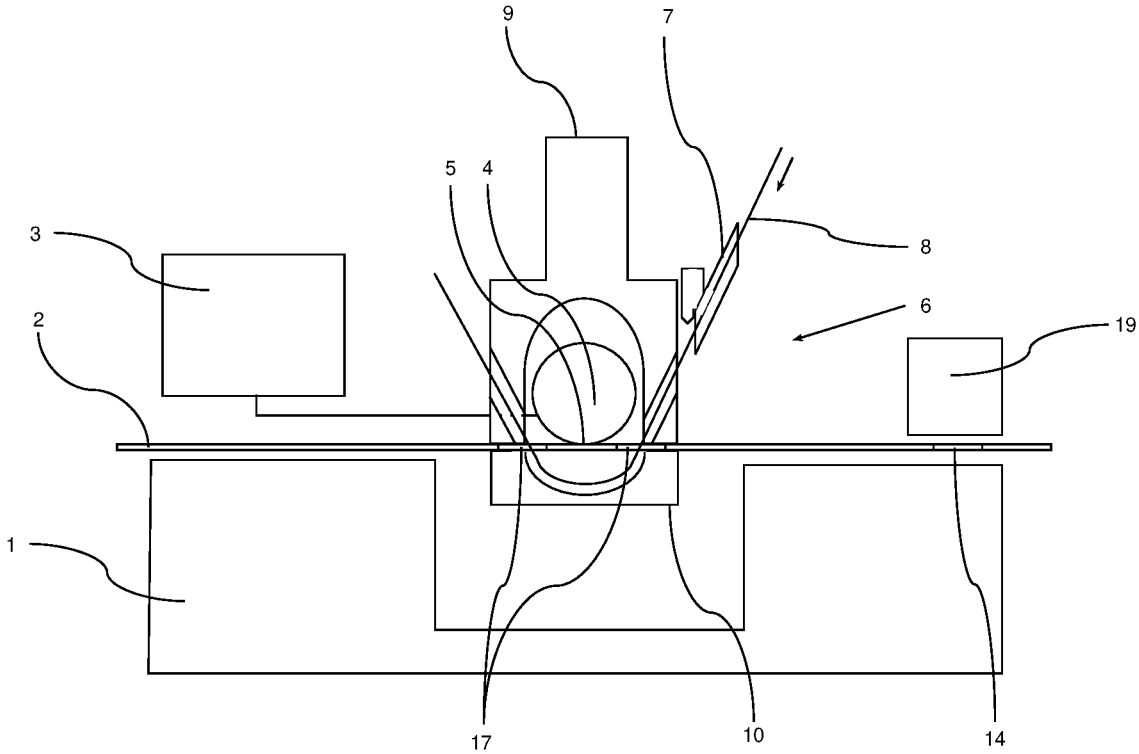

FIG. 2 shows an embodiment of the invention in a first operating state. In this operating state, a reinforcing bar 4 has already been fed onto a plurality of support strips 2 and, where necessary, positioned with respect thereto in its axial direction. The support strip conveyer 1 and the reinforcing rod conveyer 3 are shown purely schematically, and the crossing point 5 is located below the reinforcing bar 4 shown, wherein the rounded binding wire guide unit 10 is arranged below the crossing point 5 and preferably partially engages around the support strip 2 and the reinforcing bar 4. A binding wire conveying unit 7 is shown schematically. It conveys the binding wire 8 through the rotating unit 9 in the direction of the crossing point 5. The connecting unit 6 according to the invention consists of the components of the binding wire conveyer 7, the rotating unit 9 and the binding wire guide unit 10. The rotating unit 9 has a U-shaped body through which the binding wire 8 is guided.

In this embodiment, the support strip 2 is guided by a schematically shown punching unit 19 which provides in-situ guides 14 in the form of elongated holes 17 in the support strip 2. According to the invention, the guides 14 can also be, for example, triangular or dovetail-like recesses in the edge regions of the support strip 2, in particular recesses offset relative to one another diagonal to the longitudinal axis of the support strip 2 or openings 15 shaped differently from elongated holes. Alternatively, a support strip 2 already provided with guides 14 during manufacture is used according to the invention.

The operating state shown is the one before the connection. In order to create the wire loop, the rotating unit 9 and the reinforcing wire guide unit 10 are moved in a closing manner towards each other so that the binding wire 8 is fed into the wire guide unit 10 below the intersection point 5 of the support strip 2 and the reinforcing bar 4 without a gap and is then fed out again there in the opposite direction to the feed direction, wherein a specific projection length is selected depending on the diameter D of the bar 4 to be fastened after it has been fed out.

Figure 3:
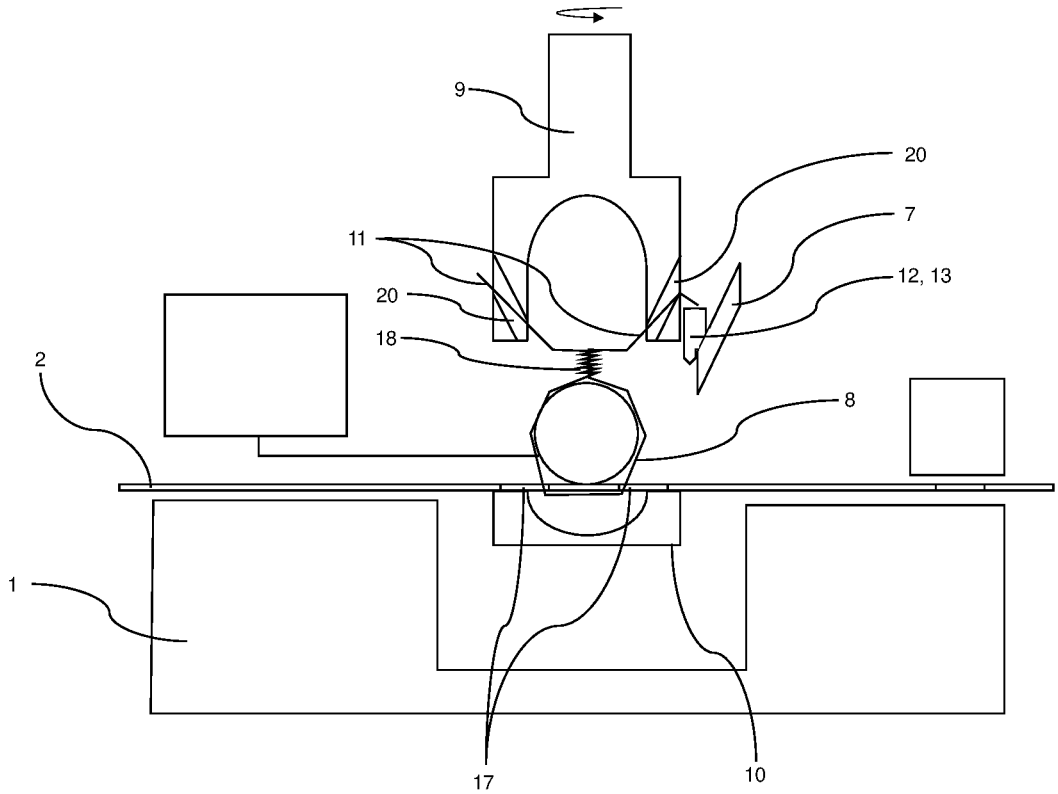

FIG. 3 shows a second operating state in which the connection is made by creating a tightened wire loop. The rotating unit 9 is raised above the bar cross-section. Here, as seen in the conveying direction of the binding wire 8, the binding wire is cut off by means of a knife 13 as a cutoff device 12 before the rotating unit 9, and the second free wire end thus created, preferably due to the shaping of the knife 13, is simultaneously bent by the latter, preferably in the direction of the reinforcing bar 2. During the rotation of the rotating unit 9, this bent end causes a pulling-out resistance against pulling out due to the shortening of the projecting wire length resulting from the twisting. This makes the binding tight and firm. The rotation against the pull-out resistance allows the two binding wire strands 11 to be twisted against each other, creating a twisting section 18. The rotation ultimately causes the bent end to slip out of the rotating unit 9. After the firm hold is released, the bar is now free. During binding, the bar and the strip are additionally pressed onto each other according to the invention and thus held in a tight position.

When the bar is transported further, the twisting section 18 is also kinked so as not to protrude too far. The binding could otherwise protrude from the concrete in the upper position or also cause injuries.

REFERENCE LIST

1 support strip conveyor
2 support strip
3 reinforcing bar conveyor
4 reinforcing bar
5 crossing point
6 connecting unit
7 binding wire conveyor
8 binding wire
9 rotating unit
10 binding wire guide unit
11 binding wire strand
12 cutoff device
13 knife
14 guide
15 opening
16
17 elongated hole
18 twisting section
19 punching unit

20 binding wire channel

A edge distance

D diameter

The invention claimed is:

1. A machine for producing uniaxial reinforcing steel bar meshes, the machine comprising:

a steel strip conveyor (1) for conveying a plurality of support strips (2), the plurality of support strips (2) being parallel to one another and spaced apart from one another; and a reinforcing bar conveyor (3), wherein the reinforcing bar conveyor (3) is configured to convey individual reinforcing bars (4) in a crossing manner onto the plurality of support strips (2), forming a crossing point (5) at each position where each of the individual reinforcing bars (4) crosses each one of the plurality support strips (2); and a plurality of connecting units (6) operatively arranged at each crossing point (5), wherein each of the plurality of connecting units (6) has a binding wire conveyer (7) configured to feed a binding wire (8) through a rotating unit (9), wherein the rotating unit (9) is configured to be movable relative to each of the plurality of support strips (2) and each of the individual reinforcing bars (4), wherein the rotating unit is arranged on a side of a plane defined by each of the plurality of support strips (2) and each of the individual reinforcing bars (4), wherein each of the plurality of connecting units (6) further has a binding wire guide unit (10), wherein the binding wire guide unit (10) is arranged on an opposite side of the plane, and wherein the binding wire guide unit (10) is configured to frictionally feed out and hold the binding wire (8) fed thereinto by the binding wire conveyer (7) in a direction reverse to an infeed direction, wherein the rotating unit (9) is configured to twist two binding wire strands (11) located on the side of the plane together and cut the two binding wire strands (11) to length, wherein the rotating unit (9) and the binding wire guide unit (10) are configured to move towards each other in a closing manner to form a wire loop connecting each of the plurality of support strips (2) and each of the individual reinforcing bars (4) in such a manner that each of the plurality of support strips (2) and each of the individual reinforcing bars (4) are pressed against each other.

2. The machine according to claim 1, wherein the rotating unit (9) comprises a cutoff device (12).

3. The machine according to claim 1, wherein the rotating unit (9) is configured to bend the two binding wire strands (11) between each of the plurality of support strips (2) and each of the individual reinforcing bars (4) from a predominantly orthogonal orientation to the plane to a predominantly parallel orientation to the plane.

4. The machine according to claim 1, wherein each of the plurality of support strips (2) comprises the guides (14), wherein the guides (14) are openings (15) in each of the plurality of support strips (2), and further comprising a punching unit (19) configured to provide the guides (14) in-situ in each of the plurality of support strips (2).

5. The machine according to claim 4, wherein the punching unit (19) is configured to form the openings (15) as elongated holes (17).

6. The machine according to claim 4, wherein the individual reinforcing bars (4) to be connected have a predetermined diameter, wherein an edge distance (A) between two adjacent guides (14) is selected based on the predetermined diameter of the individual reinforcing bars (4) to be connected, wherein the edge distance (A) is smaller than the predetermined diameter (D) of the individual reinforcing bars (4) to be fastened.

7. The machine according to claim 6, wherein a length (L) of the binding wire (8) required for connection is varied depending on the predetermined diameter of the individual reinforcing bars (4) to be connected.

* * * * *